US005503042A

United States Patent [19]

Larson et al.

[11] Patent Number: 5,503,042

[45] Date of Patent: Apr. 2, 1996

[54] ANTIFRICTION FORCE TRANSMISSION MEANS FOR PLUNGERS OF TORQUE SIGNALLING WRENCHES

[75] Inventors: John A. Larson, Arlington Heights; Talmage O. Green, Schaumburg; John K. Larson, Arlington Heights, all of Ill.

[73] Assignee: Precision Instruments, Inc., Des Plaines, Ill.

[21] Appl. No.: 152,133

[22] Filed: Nov. 16, 1993

[51] Int. Cl.[6] ..... B25B 23/142

[52] U.S. Cl. ..... 74/527; 81/478; 81/483

[58] Field of Search ..... 81/467, 478, 479, 81/483; 192/56 R; 74/526, 527

[56] References Cited

U.S. PATENT DOCUMENTS

| | | | |
|---|---|---|---|
| 4,316,397 | 2/1982 | Skidmore et al. | 81/483 |
| 4,403,531 | 9/1983 | Bailey et al. | 81/483 |
| 4,467,678 | 8/1984 | Lindholm | 81/483 |
| 4,870,879 | 10/1989 | Shieh | 81/483 |
| 5,129,293 | 7/1992 | Larson et al. . | |
| 5,152,200 | 10/1992 | Kaplan | 81/478 |
| 5,337,638 | 8/1994 | Coss et al. | 81/483 |

*Primary Examiner*—Charles A. Marmor
*Assistant Examiner*—Mary Ann Battista
*Attorney, Agent, or Firm*—Hill, Steadman & Simpson

[57] ABSTRACT

An antifriction force transmission, especially useful in torque wrenches comprises a freely rotatable cylindrical roller, opposed interface reaction surfaces in cooperative relation with the roller, and the roller and the reaction surfaces cooperating for effecting relative separating movement of the reaction surfaces when at least one of the reaction surfaces is caused to move transversely relative to the other of the reaction surfaces.

9 Claims, 2 Drawing Sheets

29
29a
15
15a
31
32
33
34
35
41
48
49
50
51

ANTIFRICTION FORCE TRANSMISSION MEANS FOR PLUNGERS OF TORQUE SIGNALLING WRENCHES

BACKGROUND OF THE INVENTION

Field of the Invention

The present invention relates to improvements in antifriction force transmission means for plungers, especially useful in torque control mechanisms for torque wrenches and the like such, for example, as disclosed in detail in U.S. Pat. No. 5,129,293 of John K. Larson and Talinage O. Green, and which patent is incorporated herein by reference for whatever help it may be to a thorough understanding of the disclosure herein, and to reduce to a comfortable minimum disclosure detail necessary for exemplifying a best mode representation of the present invention.

As described in the aforesaid patent, the torque control mechanism for wrenches described therein has a pivot block means between a force transmission member and an axially movable plunger. That mechanism has been found quite advantageous in practice, but subject to some sliding or rubbing friction which, if eliminated would improve operating functions of the associated tool.

SUMMARY OF THE PRESENT INVENTION

We have attained a greatly improved product by the provision of a new and improved antifriction roller structure to replace the pivot block arrangement described in the aforesaid patent, thereby enhancing operating results of the associated tool beyond the substantially improved results attained by means of the pivot block arrangement. The reduction in friction attained enhances accuracy and repeatability of torque (or force) release value in the associated torque wrench tool. Extension of apparatus life is attained. Extended adjustment of spring rate is effected to accept wider reaction spring tolerances.

In accordance with the principles of the present invention, there is provided new and improved antifriction force transmission means for action between opposed interface ends of members one of which is reciprocative relative to the other, and said other member being non-reciprocative but transversely movable relative to said one member, and comprising a freely rotatable cylindrical roller, a respective interface reaction surface means at each of said opposed member ends for cooperative engagement with said roller, and said roller and said reaction surface means cooperating for effecting reciprocative movement of said reciprocative member when said transversely movable member moves transversely.

The concept as broadly set forth, is especially useful in torque control mechanisms for wrenches and the like as set forth in the foregoing U.S. Patent, and in which the force transmission roller and complementary reaction surface means cooperate between a rockably mounted force transmission member and a spring biased reciprocative plunger.

BRIEF DESCRIPTION OF THE DRAWINGS

Other objects, features and advantages of the present invention will be readily apparent from the following description of a best mode embodiment thereof, taken in conjunction with the accompanying drawings, although variations and modifications may be effected without departing from the spirit and scope of the novel concepts of the disclosure, and in which.

DETAILED DESCRIPTION OF A BEST MODE EMBODIMENT

Figure 1:
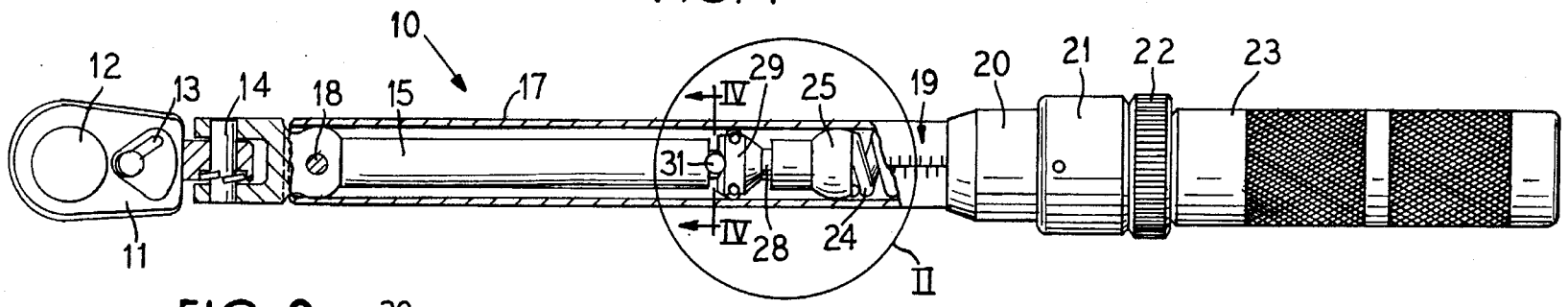
FIG. 1 is an elevational view, partially broken away to reveal details of structure, of a micrometer adjustable click wrench embodying the present invention.

FIG. 1 depicts a hand tool 10 of the micrometer adjustable click wrench kind described in the aforesaid U.S. Pat. No. 5,129,293 and in which, in the present instance, is embodied the new and improved antifriction force transmission means of the present invention. The tool 10 has a drive head 11 with a rotary ratchet controlled output or drive member 12 and a ratchet selecting lever 13, by which the drive member 12 can be controlled for either clockwise or counterclockwise driving torque, clockwise driving torque being indicated by the position of the lever 13 as shown. The head 11 is connected by means of a swivel knuckle 14 to the proximal, clevis head end of a force transmitting elongate rod-like member 15 extending longitudinally in a tubular case or housing 17 which is attached rockably at one end by means of a pin 18 to the force transmission member 15. The tubular housing 17 has on its outer perimeter an incremented scale 19 adjacent to a thimble 20 attached to a lock ring retainer 21 with which is associated a lock ring 22 at the proximal end of a handle 23. Within the handle 23 is a coil compression biasing spring 24 which has an inner end thrusting against a balance cam 25. Within a socket 27 in the balance cam 25 is assembled a complementary elongate stem or boss 28 of a plunger 29 equipped with antifriction side thrust rollers 30 in accordance with the disclosure in U.S. Pat. No. 5,244,284 dated Sep. 14, 1993, and which to any extent necessary is incorporated herein by reference.

Bias force of the spring 24 drives the assembly including the plunger 29 toward the opposed end of the force transmission member 15, with a cylindrical antifriction roller 31, in accordance with the present invention, active between opposed adjacent interface ends 15*a* and 29*a*, respectively, of the force transmission member 15 and the plunger member 29. One of the members between which the roller 31 is active, herein the plunger member 29, is reciprocatable in the housing 17, whereas the other member, herein the force transmission member 15, is mounted rockably, i.e. transversely movable, relative to the reciprocatable plunger member 29. In the torque wrench 10, the roller 31 may be referred to as a release roller.

In its assembly between the ends of the members 15 and 29, the roller 31 is disposed in freely rotatable relation and is cradled in cooperative generally concave reaction interface surface means comprising a channel-like diametrically extending concave roller-receiving or cradling surface 32 across the distal end face of the plunger 29. Narrow shallow-angle ramp surfaces 33 border each side and slope toward the concave roller cradling surface 32. In mirror image relation to the surfaces 32 and 33, the adjacent interface surface means end of the force transmission member 15 is provided with a roller cradling concave diametric surface 34 bordered by ramp surfaces 35 sloping toward the surface 34.

For keeping the roller 31 centered with respect to the interface roller cradling surface 32 and ramps 33, and interface roller cradling surface 34 and ramps 35 the roller 31 has co-rotatable therewith midway between its ends a radially extending annular centering collar 37. The collar 37 is received in a clearance groove 38 extending diametrically normal to the surfaces 32 and 33 in the interface **29*a* of the plunger 29, and a matching diametrically extending clearance groove 39 in the adjacent interface end 15*a* of the force transmission member 15 and extending normal to the surfaces 34 and 35**.

On the collar 37 is a perimeter 40 which is adapted to cooperate in controllable relation with a distal end of a spring rate pin 41 slidably received in an axial bore 42 in the plunger stem or boss 28. A spring rate adjustment screw 43 is threadedly engaged in a threaded bore extension 44 opening through the distal end of the stem 28. The screw 43 at its proximal end thrusts against the inner end of the spring rate pin 41. For longitudinally threadedly adjusting the screw 43 in the threaded bore 44, the distal end of the screw 43 has means such as a hex wrench socket 45 which is accessible through the adjacent open end of the stem 28 and an aligned opening 47 in the end of the balance cam 25 which is engaged by the spring 24. An elongate conventional hex wrench (not shown) is adapted to be extended axially through the spring 24 and the opening 47 into the socket 45 for threadedly axially adjusting the position of the screw 43 in the threaded bore 44 and thereby adjusting the position of the outer end of the pin 41 relative to the collar perimeter 40.

Figures 6, 6A, 6B, 7, 7A, 7B, 8, 8A, 8B:
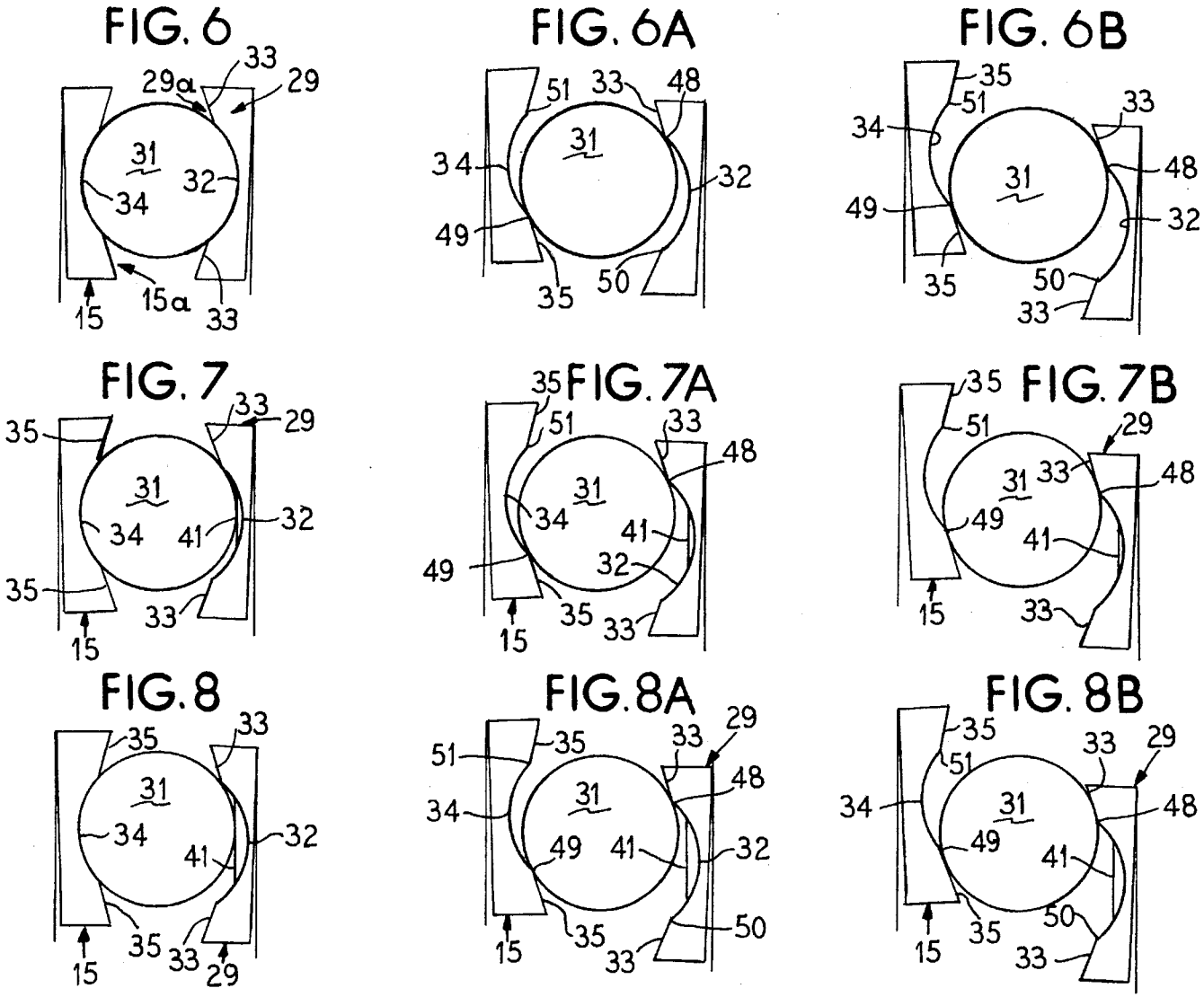
FIGS. 6, 6A and 6B are progressive action schematics showing the antifriction roller and interface reaction surface means of the present invention in one operating sequence.
FIGS. 7, 7A and 7B are progressive action schematics of the antifriction roller and interface reaction surface means of the present invention in a second operating sequence.
FIGS. 8, 8A and 8B are progressive action schematics of the antifriction roller and interface reaction surface means of the present invention in a third operating sequence.

FIGS. 6, 6A and 6B schematically illustrate relative positions of the roller 31 and the interface ends **15*a* and 29*a* of the force transmission member 15 and the plunger member 29 when a clockwise wrenching action of the tool 10, as shown in FIG. 1, is to be effected and the spring rate pin 41 is fully retracted. FIG. 6 shows the at rest position of the roller 31 in the concave surfaces 34 and 32, respectively, in the interfaces 15*a* and 29*a*. FIG. 6A shows the relation of the interfaces in a half-release position wherein the force transmission member 15 is rocked halfway relative to the plunger 29, and the roller 31 has been caused to ride to a position wherein diametrically opposite points engage a juncture ridge 48 between the concave surface 32 and the ramp surface 33 at one side of the plunger interface 29*a*. At the same time a ridge 49 between the concave surface 34 and the ramp surface 35 at the opposite side of the interface 15*a* of the member 15 is engaged by the roller 31. At full release, as shown in FIG. 6B the roller 31 advances onto the ramps 33 and 35 as shown. This arrangement, affords maximum interference to the force transmission member 15**.

Figure 2:
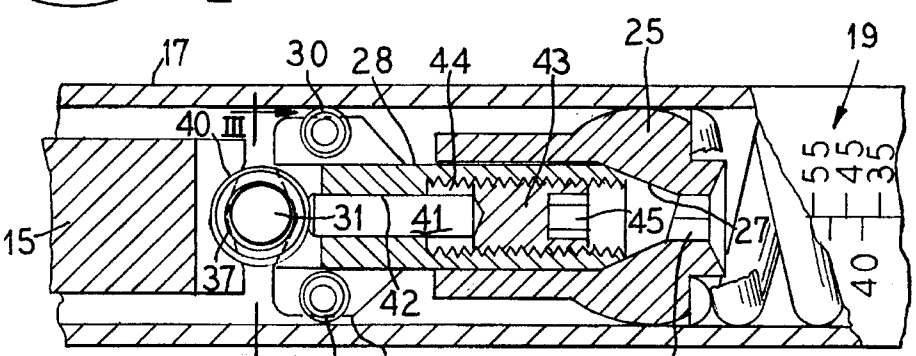
FIG. 2 is an enlarged fragmentary sectional detail of that portion of FIG. 1 within the circle II.
Figure 5:
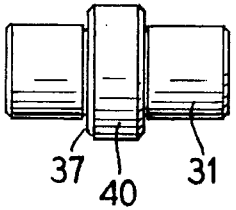
FIG. 5 is a side elevational view of the force transmission roller which is also shown in FIGS. 1 and 2.
Figure 3:
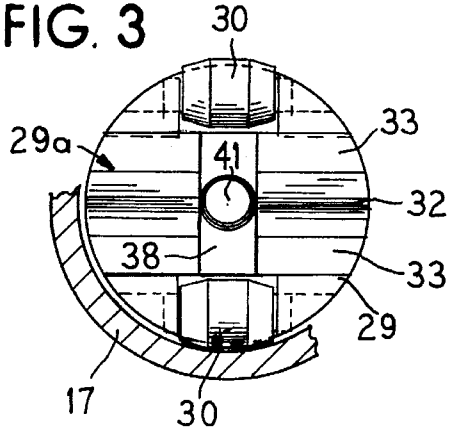
FIG. 3 is a sectional plan view taken substantially along the line III—III in FIG. 2.
Figure 4:
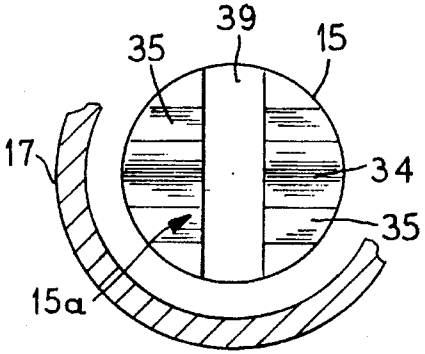
FIG. 4 is a sectional plan view taken substantially along the line IV—IV in FIG. 1.

For lesser interference to the force transmission member 15, FIGS. 7, 7A and 7B schematically illustrate relative positions of the roller 31 and the interface ends **15*a* and 29*a* of the force transmission member 15 and the plunger 29 when, similarly as in FIG. 6, wrenching action of the tool 10, as shown in FIG. 1, is to be effected, but the spring ratio pin 41 is projected or extended to an intermediate position. In the intermediate position the spring rate pin 41 engages the roller collar 37 perimeter 40 substantially as shown in FIG. 2, but only represented in FIGS. 7, 7B as a schematic showing of pin 41 and omitting the collar 37 as unnecessary here to demonstrate the effect of the pin 41 and collar 37 at the intermediate position. As shown in FIG. 7, engagement of the pin 41 with the collar 37 causes an initial slight rocking bias of the force transmission member 15. Then, as shown in FIG. 7A, in the half-release position, wherein the force transmission member 15 is rocked halfway relative to the plunger 29, the roller 31 has been caused to ride to a position wherein diametrically opposite points engage the juncture ridges 48 and 49. The biased displacement then attained of the force transmission member 15 includes the bias distance shown in FIG. 7A plus the initial bias distance shown in FIG. 7. The initial bias distance of FIG. 7 persists in the full release biased position as shown in FIG. 7**B.

When the spring rate pin 41 is extended to maximum position as schematically depicted in FIGS. 8, 8A and 8B, the minimum interference to the force transmission member 15 is attained, and there is a corresponding initial or at rest bias displacement of the member 15 greater than the at rest bias displacement shown in FIG. 7. That initial bias displacement is added to and reflected in the half release bias displacement of FIG. 8A and the full release bias displacement in FIG. 8B.

It will be understood that if the ratchet selecting lever 13 in FIG. 1 is reversed, for counterclockwise driving torque, that the same results will be accomplished, but in reverse order, in FIGS. 6, 6A and 6B, FIGS. 7, 7A and 7B, and FIGS. 8, 8A and 8B. For the reverse or counterclockwise torque application results, the interface **29*a* is provided with a juncture ridge 50 at the opposite side from the juncture ridge 48, and the interface 15*a* is provided with a juncture rib 51 at the opposite side from the juncture rib 49**.

It will be apparent that various modifications and/or additions may be made in the apparatus of the present invention without departing from the essential features of novelty involved, which are intended to be defined and secured by the appended claims.

We claim as our invention:

1. A new and improved antifriction force transmission means for action between opposed ends of members, at least one of which is reciprocal relative to the other, and said other member being non-reciprocal but transversely movable relative to said one member, and comprising:

a freely rotatable cylindrical roller;

a respective interface reaction surface means at each of said opposed ends for cooperative engagement with said freely rotatable cylindrical roller; and said freely rotatable cylindrical roller and said interface reaction surface means cooperating for effecting reciprocative movement of said one member when said other member moves transversely and when said freely rotatable cylindrical roller rotates about its axis, wherein said interface reaction surface means comprise respective concave roller surfaces and ramp surfaces leading to said concave surfaces, and juncture ridges between said concave surfaces and said ramp surfaces on which said freely rotatable cylindrical roller rolls, wherein said freely rotatable cylindrical roller has a radially extending collar intermediate its length, and said interface reaction surface means have clearance grooves thereacross for receiving said collar.

2. An antifriction force transmission means according to claim 1, further comprising: means coactive with said collar for modifying the action of said freely rotatable cylindrical roller and said interface reaction surface means.

3. An antifriction force transmission means according to claim 2, wherein said coactive means comprises a pin carried by said one member engaging at one end with a perimeter on said collar, and means for adjusting said pin relative to said collar.

4. In combination with a torque control mechanism for a torque wrench tool, a new and improved antifriction force transmission means for action between opposed interface means of a rockably mounted force transmission member and a reciprocable plunger, and comprising:

a freely rotatable cylindrical roller;

a respective interface reaction surface means at each of said interface means for cooperative engagement with said freely rotatable cylindrical roller; and said freely rotatable cylindrical roller and said interface reaction surface means cooperating for effecting reciprocative movement of said reciprocable plunger when said force transmission member is rocked and when said freely rotatable cylindrical roller rolls about its axis, wherein said interface means comprise respective concave roller engaging surfaces and ramp surfaces leading to said concave roller engaging surfaces, and juncture ridges between said concave roller engaging surfaces and said ramp surfaces on which said freely rotatable cylindrical roller rolls, wherein said freely rotatable cylindrical roller has a radially extending collar intermediate its length, and said interface reaction surface means have clearance grooves thereacross for receiving said collar.

5. A combination according to claim 4, including means coactive with said collar for modifying action of said freely rotatable cylindrical roller and said interface reaction surface means.

6. A combination according to claim 5, wherein said coactive means comprises a pin carried by said reciprocable plunger engaging at one end with a perimeter on said collar, and means within said reciprocable plunger for adjusting said pin relative to said collar.

7. A new and improved antifriction force transmission means, comprising:

a freely rotatable cylindrical roller:

opposed interface reaction surface means in cooperative engagement with said freely rotatable cylindrical roller; and said freely rotatable cylindrical roller and said interface reaction surface means cooperating for effective relative separating movement of said interface reaction surface means when at least one of said interface reaction surface means is caused to move transversely relative to another of said interface reaction surface means and when said freely rotatable cylindrical roller rolls about its axis, wherein said interface reaction surface means comprise respective concave roller engaging surfaces and ramp, surfaces leading to said concave roller engaging surfaces, and juncture ridges between said concave roller engaging surfaces and said ramp surfaces on which said freely rotatable cylindrical roller rolls, wherein said freely rotatable cylindrical roller has a radially extending collar intermediate its length, and said interface reaction surface means have clearance grooves for receiving said collar.

8. An antifriction force transmission means according to claim 7, including means coactive with said collar for modifying action of said freely rotatable cylindrical roller and said interface reaction surface means.

9. An antifriction force transmission means according to claim 8, wherein said coactive means comprises a pin engaging at one end with a perimeter on said collar, and means for adjusting said pin relative to said collar.

* * * * *